US006595900B1

(12) United States Patent
Cook

(10) Patent No.: US 6,595,900 B1
(45) Date of Patent: Jul. 22, 2003

(54) JUMP ROPE

(76) Inventor: Arnold J. Cook, 413 N. Pasadena Dr., Pittsburgh, PA (US) 15215

( * ) Notice: Subject to any disclaimer, the term of this patent is extended or adjusted under 35 U.S.C. 154(b) by 0 days.

(21) Appl. No.: 09/640,621

(22) Filed: Aug. 17, 2000

Related U.S. Application Data

(63) Continuation-in-part of application No. 09/017,535, filed on Feb. 2, 1998, now abandoned.

(51) Int. Cl.[7] ..... A63B 5/20
(52) U.S. Cl. ..... 482/82; 482/81; 482/126
(58) Field of Search ..... 482/126, 81, 82, 482/124, 74

(56) References Cited

U.S. PATENT DOCUMENTS 1,629,209 A * 5/1927 Fairbanks ..... 482/82
2,719,038 A * 9/1955 Massa ..... 482/82
4,505,474 A * 3/1985 Mattox ..... 482/82
4,801,137 A * 1/1989 Douglass ..... 482/82
4,865,316 A * 9/1989 Yeaman ..... 482/126
5,876,310 A * 3/1999 MacKey et al. ..... 482/74

FOREIGN PATENT DOCUMENTS

GB 2166058 A * 3/1984 ..... 482/82

* cited by examiner

*Primary Examiner*—Jerome W. Donnelly
(74) *Attorney, Agent, or Firm*—Ansel M. Schwartz

(57) ABSTRACT

A jump rope handle for a jump rope. The jump rope comprises a handle portion having a receiving area. The handle portion has a non-linear axis which is adapted to be held by a hand of a user which does not require any bending of the wrist of the hand of the user. The handle comprises a mechanism for holding a rope. The holding mechanism mates with the receiving area to connect with the handle portion. A rubber rope made with a durometer less than 60 shore A. A method of a user exercising. The method comprises the steps of gripping a first handle of a jump rope with a right hand of the user. Then there is the step of gripping a second handle of the jump rope with a left hand of the user. Next there is the step of jumping the jump rope by the user while the user does not bend the wrist of either the right or left hand.

13 Claims, 8 Drawing Sheets

JUMP ROPE

This application is a continuation-in-part of application (s) application Ser. No. 09/017,535 filed on Feb. 2, 1998 now abandoned.

FIELD OF THE INVENTION

The present invention is related to jump ropes. More specifically, the present invention is related to a jump rope having handles that are gripped by a user so the exerciser does not have to bend his wrists to twist the rope as he jumps.

BACKGROUND OF THE INVENTION

The jumping of rope is one of the simplest and best ways of getting an outstanding strengthening and cardiovascular workout. It builds coordination, helps endurance, increases bone density and muscle strength. In many ways, it is better than running because it uses more muscle groups at one time.

Current jump ropes employ simple cylindrical shape handles on the end of fabric, leather, or hard vinyl ropes. Because of this, the fingers must be contorted around the handles and the wrist must be bent at an awkward angle in order to have the tope exiting the grip at the right angle to jump. Existing ropes are either too soft and too light for high speed or too hard such that they are quite painful when you hit your body.

SUMMARY OF THE INVENTION

The present invention consists of non-cylindrical grip which is contoured to the natural position of the hand when a rope is held between the thumb and index finger. The grip fits in the natural closed fist position of the hand so that the rope exits the grip and the hand at the correct angle so no bending of the wrist is necessary. The handle is injection molded out of a rubberized polymer, for added comfort, and includes a means for weighting the handle with insert or forming the handle out of a metal containing polymer. The handle also includes a unique method for adjusting the length of the rope by popping out the bearing with an instrument through a key hole.

The rope itself is made from a soft rubber instead of hard leather or vinyl and it may be solid rubber, hollow, or weighted inside; to change its speed and performance.

The present invention pertains to a jump rope handle for a jump rope. The jump rope comprises a handle portion having a receiving area. The handle portion has a non-linear axis which is adapted to be held by a hand of a user which does not require any bending of the wrist of the hand of the user. The handle comprises a mechanism for holding a rope. The holding mechanism mates with the receiving area to connect with the handle portion.

The present invention pertains to a rubber rope made with a durometer less than 60 shore A.

The present invention pertains to a method of a user exercising. The method comprises the steps of gripping a first handle of a jump rope with a right hand of the user. Then there is the step of gripping a second handle of the jump rope with a left hand of the user. Next there is the step of jumping the jump rope by the user while the user does not bend the wrist of either the right or left hand.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
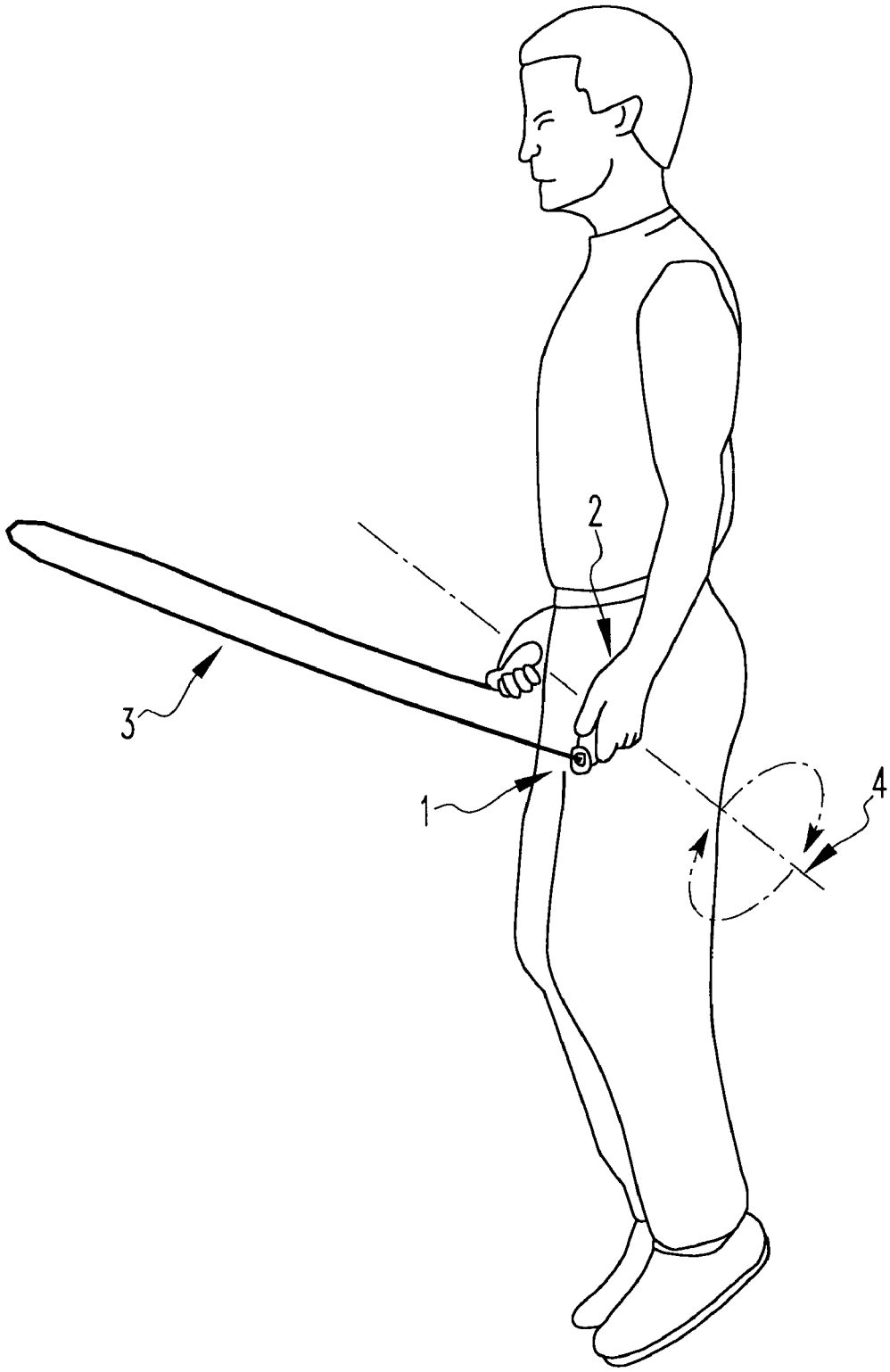
FIG. 1 is an elevation showing a person jump a standard rope and the rotation axis of the rope.

Referring now to the drawings wherein like reference numerals refer to similar or identical parts throughout the several views, and more specifically to FIG. 1 thereof, there is shown a jump rope handle 6 for a jump rope. The jump rope comprises a handle portion 111 having a receiving area 112 and an end. The handle portion 111 has a non-linear central axis which has a continuously curved radius of curvature of between 2–3 inches that extends entirely along the length of the handle portion from the receiving area to the end of the handle, is adapted to be held by a hand of a user which does not require any bending of the wrist of the hand of the user. The handle 6 comprises a mechanism 114 for holding a rope. The holding mechanism 114 mates with the receiving area 112 to connect with the handle portion 111.

The handle portion 111 preferably has a non-cylindrical shape which is adapted to contour to the hand such that the rope 25 exits the hand between the index finger and the thumb of the user. The handle portion 111 can be held by all fingers. The handle portion 111 preferably is made of a rubberized polymer. Alternatively, the handle portion 111 is made out of a polymer containing metal. Preferably the handle portion 111 includes a weight 61. The handle portion 111 preferably includes a weight 61 disposed inside the handle portion 111.

Preferably, the holding mechanism 114 includes a bearing assembly 83 where the rope 25 exits the handle portion 111. The holding mechanism 114 preferably includes a key hole 81 for popping out the bearing assembly 83 to adjust or replace the rope 25. Preferably, the holding mechanism 114 includes a retaining collar 92 which can be moved up and down on the rope 25.

A rubber rope 25 made with a durometer less than 60 shore A. The rope 25 is preferably hollow. Preferably the rope 25 has a hollow tube and includes material which is disposed in the hollow tube. The rope 25 preferably includes braided wire for weight and form.

A method of a user exercising. The method comprises the steps of gripping a first handle 20*a* of a jump rope 25 with a right hand of the user. Then there is the step of gripping a second handle 20*b* of the jump rope 25 with a left hand of the user. Next there is the step of jumping the jump rope 25 by the user while the user does not bend the wrist of either the right or left hand. Preferably the gripping steps include the steps of gripping the handle 20 so the rope 25 exits the respective hand between the thumb and index finger.

Jumping rope, as shown in FIG. 1, uses the legs and feet to jump at the same time the arms, hands, and wrists are used to move the rope. Everything must be timed perfectly in order for the rope to swing under the feet. If the rope is weighted correctly and if the rope is the correct length, only a small amount of wrist movement is required to swing the rope. Smaller movements allow the jumper to jump fast or to do double or triple jump where the rope passes two or three times under the feet before they touch the ground again.

Figure 2:
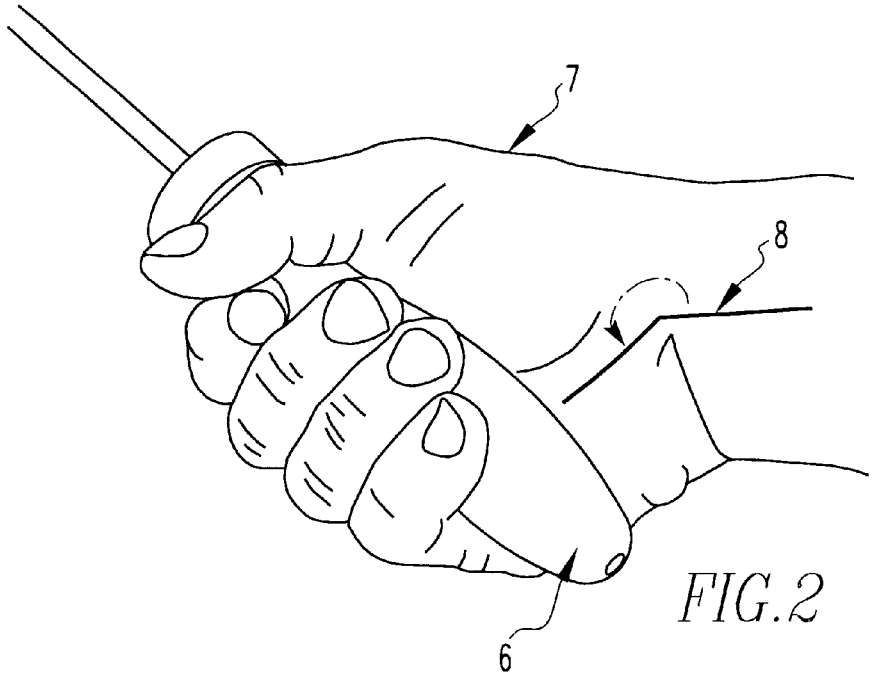
FIG. 2 is a drawing of a hand with a standard cylindrical jump rope handle showing the bend angle of the wrist.

Current jump rope handles are cylindrical in shape, the shape require the wrists 2 to be extremely bent to obtain a good axis 4 for the rope 3 to be rotated on. FIG. 2 shows a typical jump rope handle 6 held in a hand 7. In order to use this handle 6, the wrist 2 must be at an angle 8 beyond 180 degrees. This angle 8 is near the extreme maximum the joints of the hand allow and the angle limits the wrist's ability to make a circular rotation. The angle itself is also contraindicated for this joint and prolonged use at this angle could cause joint pain and possible damage.

Figure 3:
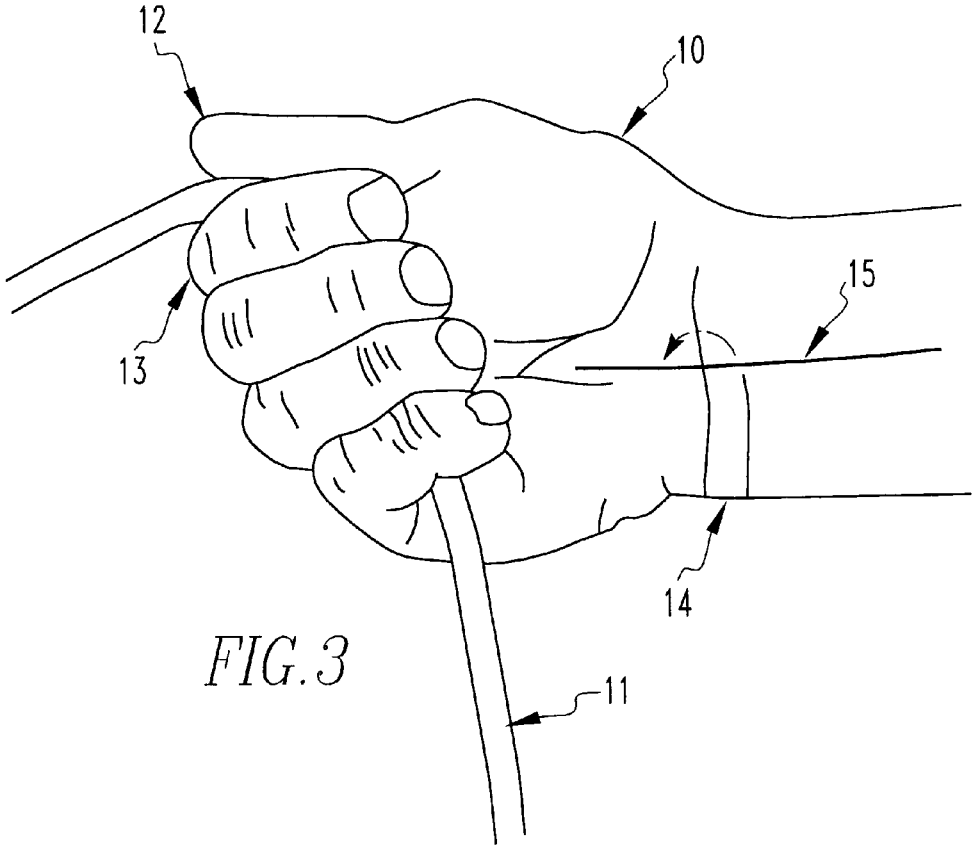
FIG. 3 is a drawing of a rope in the hand showing the natural position of the fingers, thumb and wrist.

FIG. 3 shows a hand holding a rope 11 in a natural position for jumping. The rope 11 exits the hand 10 between the thumb 12 and index FIG. 13. This natural holding position requires no bending of the wrist 14 and has a wrist angle 15 of 180 degrees. The only wrist movement is required to rotate the rope.

Figure 4:
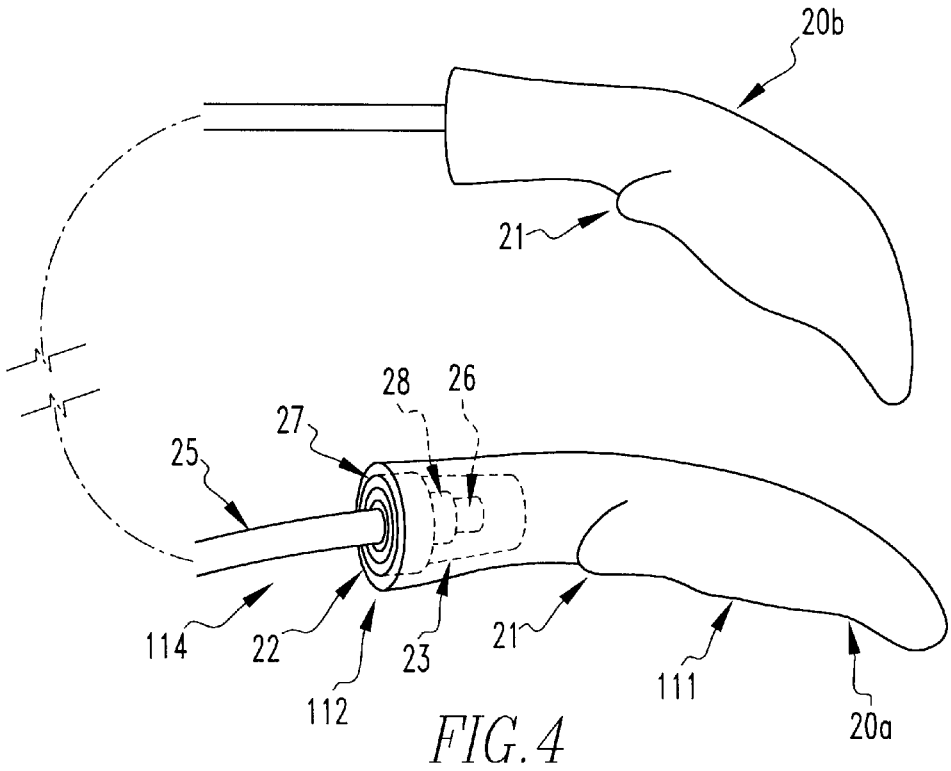
FIG. 4 is an example handle which contours to the natural position of the hand.

FIG. 4 shows two views of a unique jump rope handle 20 which fits into the hand in the same way that the rope 11 in FIG. 3 fits into the hand. The handle 20 is non-cylindrical with a bent axis to allow the finger to hold the rope and let the rope exit between the thumb and index finger. The handle 20 design includes a ridge 21 for locating the index finger and a bearing 22 to allow the rope to rotate smoothly. The handle 20 is injection molded with a cavity to hold the bearing 22 with a cavity 22 behind to allow the end of the rope 25 and rope stop 26 to rotate inside. The rope stop 26 shown is an aluminum wire ring crimped onto the end of the rope 25. The cavity 23 may include a lip 27 to hold the bearing 22 in place after it is pressed. The cavity 23 may also include a key hole 28 which may be used to pry out the bearing 22 to allow the length of the rope 25 to be changed. Many different materials may be used for the handle, but a thermoplastic elastomer is preferred with a durometer between 20–50 shore A. This material provides a soft tactile feel against the skin, however any plastic, wood, or metal with or without padding may be used.

Figure 5:
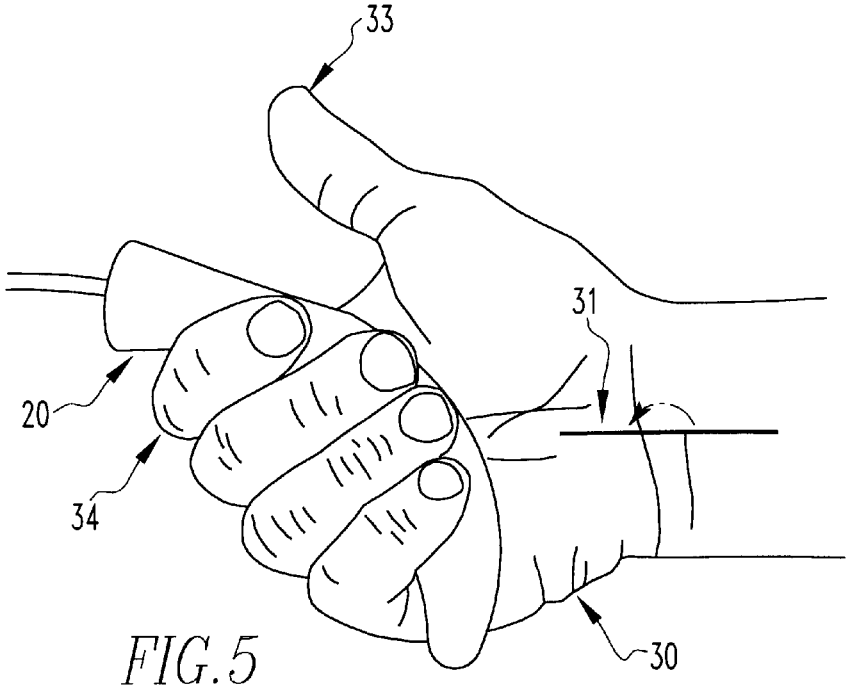
FIG. 5 shows the handle in FIG. 4 in a person's hand.

FIG. 5 shows the handle 20 from FIG. 4 in a hand 30. The handle 20 follows the same axis as the rope 11 shown in FIG. 3. Because the handle 20 is designed to the contours of the hand 30, no wrist bending is required, the fingers can hold the handle 20 without the thumb 33, and the rope 11 exists between the thumb 33 and index finger 34. The wrist angle 31 is 180 degrees, and shows no bending is required.

Figure 6:
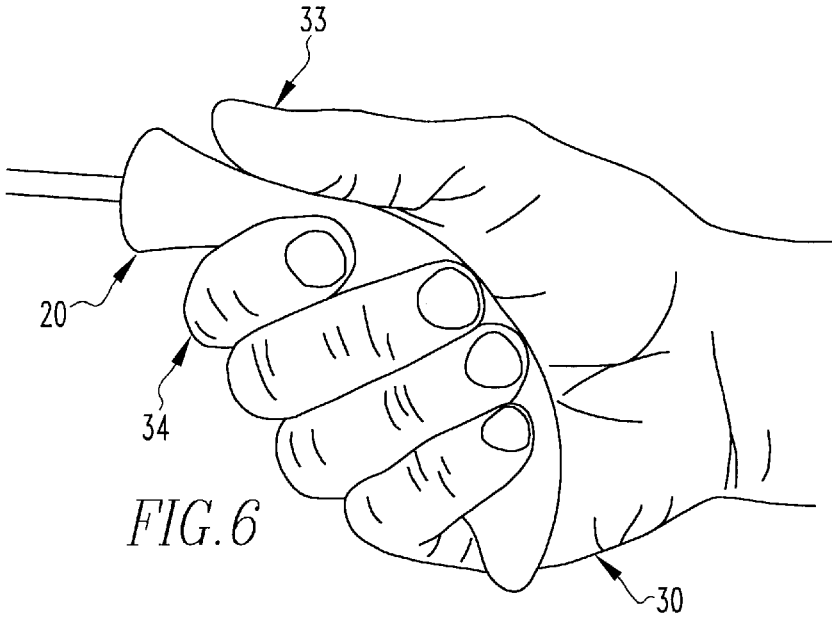
FIG. 6 shows the handle with the thumb against the grip.

FIG. 6 shows the handle 20 in the hand 30 with the thumb 33 holding the handle 20. The handle 20 design is more comfortable because it removes the need to bend the wrist to extreme angles and because it allows the rope to exit between the index finger 34 and the thumb 33. The design makes jumping faster possible because less wrist action is required and a smoother rotation can be obtained. The design is similar to a gun pistol grip. Pistol grips have evolved so that the wrist is now held in a neutral position, with no bending for accuracy, safety, and strength.

Figure 7:
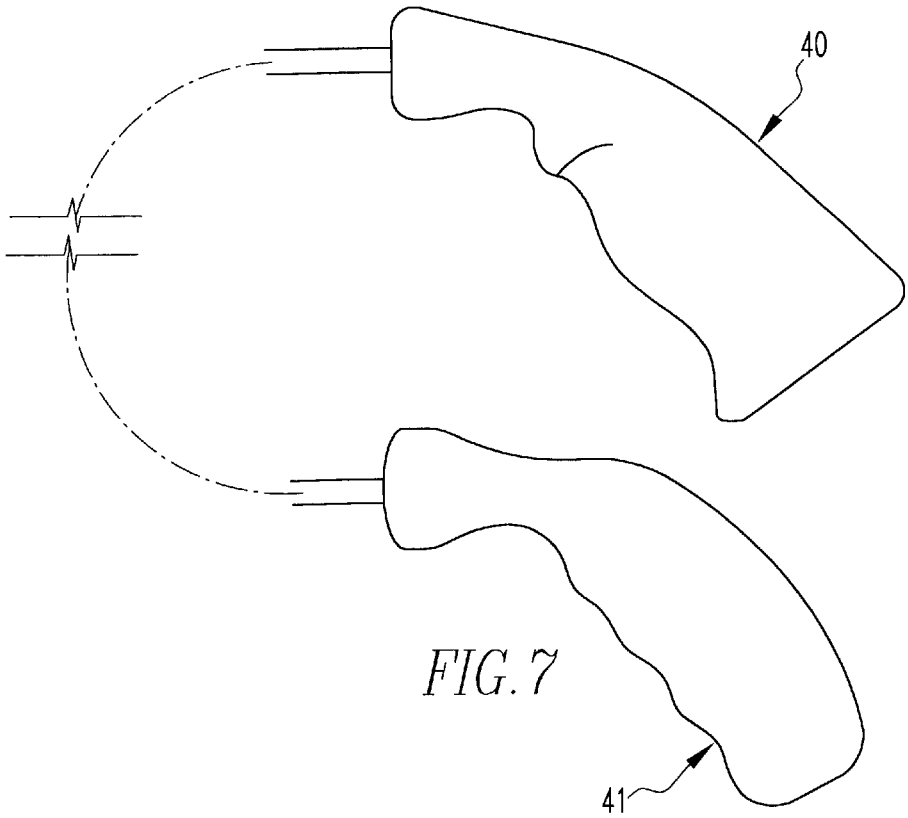
FIG. 7 shows some alternative embodiments.

FIG. 7 shows two additional handles designs with non-cylindrical axis, these are shown to illustrate the fact that other designs may be generated based on this concept which conforms to the shape of the hand and allows the rope to exit between the thumb and index finger. Handle 40 has a large end and requires less bending of the small finger while handle 41 has positioning ridges for each of the four finger of the hand.

Figure 8:
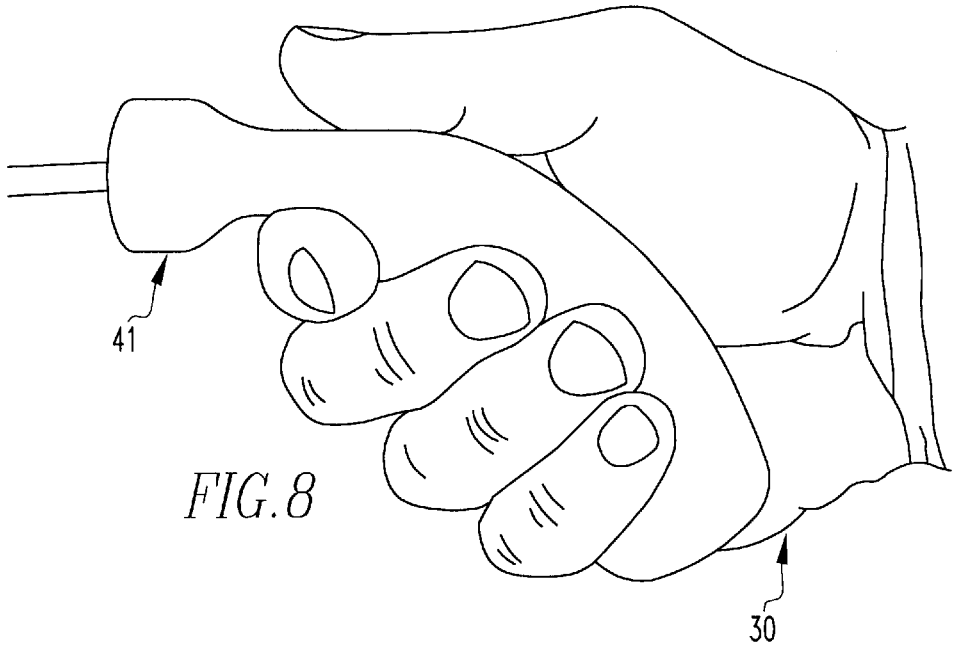
FIG. 8 shows an alternative handle in a person's hand.

FIG. 8 shows handle 41 in the hand 30 and how it conforms and allows the rope to exit at the desired position between the thumb and index finger without bending the wrist.

Figure 9:
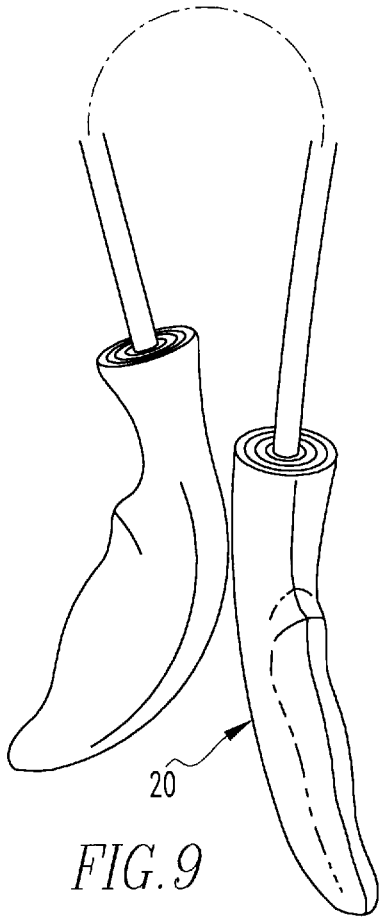
FIG. 9 shows a pair of handles at different angles.

FIG. 9 shows a pair of jump rope handles 20 at two different angles so the form can be illustrated and understood.

Figure 10:
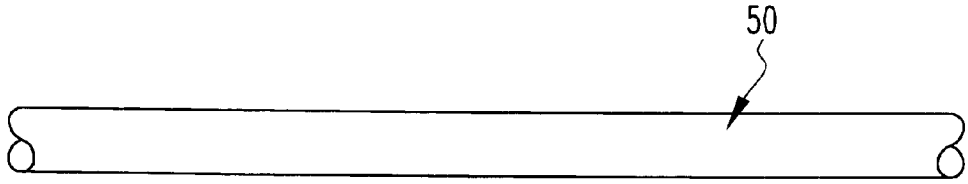
FIG. 10 shows a solid, soft rubber rope.

FIG. 10 shows a preferred jump rope 50, ¼ inches in diameter made out of buna-n, o-ring material sold to make o-ring seals. Different diameters from 1/16" to 3/16" work well, but diameters around ¼" give a nice feel. The buna-n, o-ring material is soft and flexible and does not kink or hurt as much as vinyl when it hits the skin.

Figure 11:
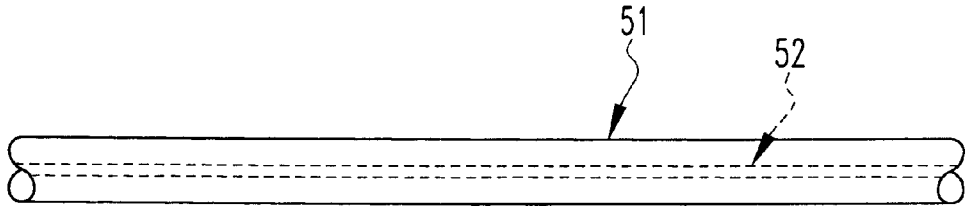
FIG. 11 shows a weighted soft rubber rope containing stranded copper wire.

FIG. 11 shows a rope 51 with a soft rubber outer casing and a stranded copper wire 52 inside. The rope 52 is a power cord material, single or multiconductor. It can be used to create a heavier rope, heavier ropes increase the work required of the arms and can make faster jumping possible. Weighted ropes can therefore provide a more intense workout.

Figure 12:
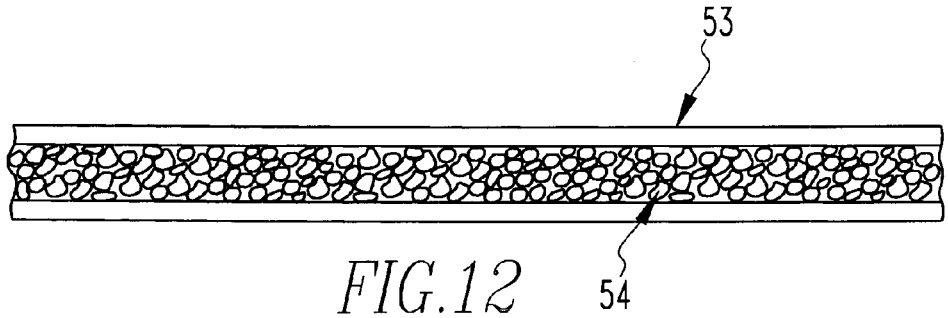
FIG. 12 shows a weighted rope created by putting metal shot inside a soft, hollow rubber rope.

FIG. 12 shows a hollow flexible rope 13 which is actually tubing with metal shot 54 or BBs inside for added weight. This design makes it possible to adjust the weight of the rope.

Figure 13:
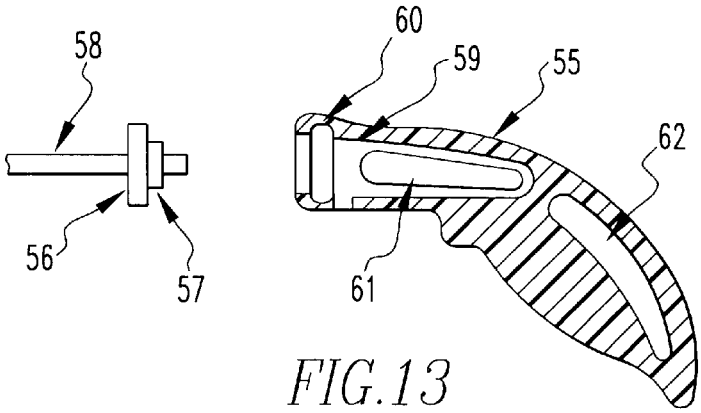
FIG. 13 shows a contoured handle with weight inserts.

FIG. 13 shows a handle 55 cross section with the bearing 56, stop 57 and rope 58 removed from the cavity 59 and bearing groove 60. In the back of this cavity 59, a weight 61 may be placed to provide more work for the arms. In this system, the weight 61 is removable. In addition, FIG. 13 shows another weight 62 which is imbedded in the handle 55 with the plastic molded around it. This weight 62 is not removable.

Figure 14:
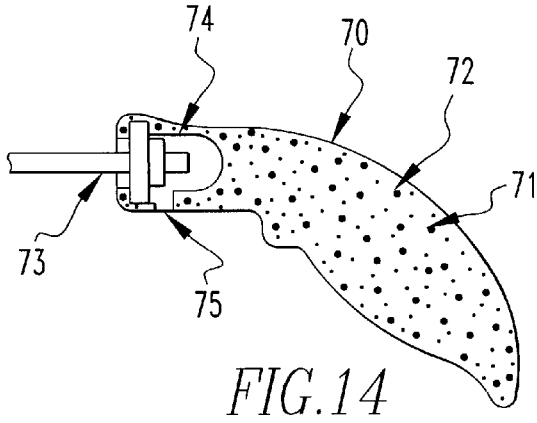
FIG. 14 shows a weighted metal composite handle cross section.

FIG. 14 shows a composite handle 70 cross section, where the plastic is made up of a composite of thermoplastic 72 and metal particles 71, the metal particles 71 add density to the handle 70 and provide more weight for the arms to exercise with. FIG. 14 also shows a jump rope/bearing assembly 73 snapped into a bearing cavity 74. FIG. 14 also shows a key hole 75 into the baring cavity 74 which may be used to snap out the rope/bearing assembly 73 in case the bearing or the rope need to be changed.

Figure 15:
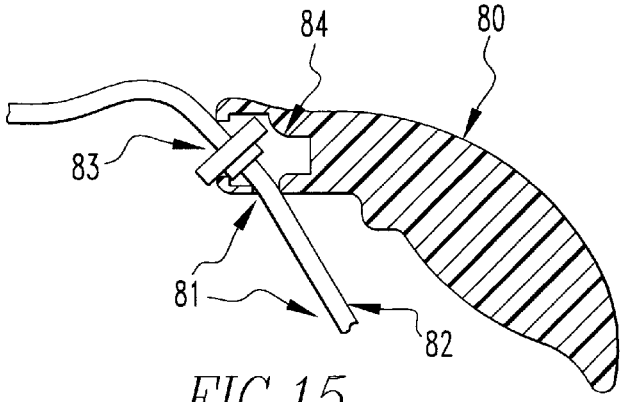
FIG. 15 shows adjusting of the rope length by snapping out the bearing and moving the spring clip.

FIG. 15 shows a handle 80 cross section where the rope/bearing assembly 83 is being pried out of the handle 80 by a rod 82 inserted through the key hole 81 such that it acts as a lever and pushes the rope/bearing assembly 83 out of the bearing cavity 84.

Figure 16:
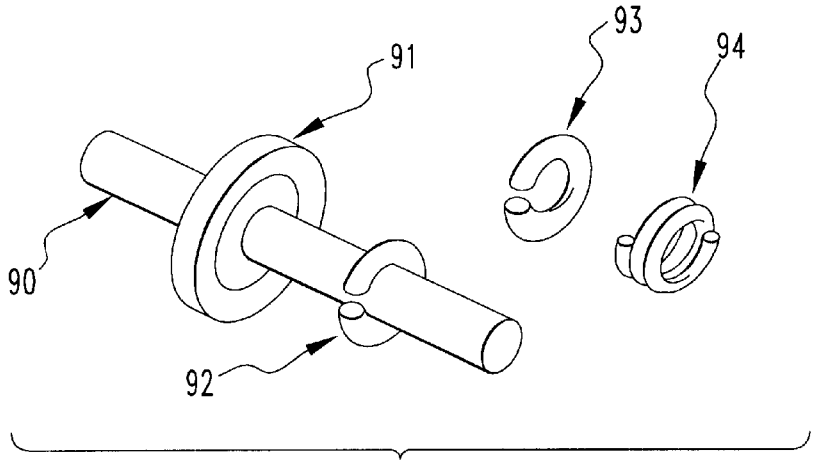
FIG. 16 shows the end of the rope going through a bearing with a wire ring crimped on the rope which acts as a stop.

FIG. 16 shows how the rope 90 is kept from sliding through the bearing 91. A stiff aluminum copper, steel or other material collar 92 is crimped around the rope 90 so that it does not cut into the rope 90 and will not slide. Aluminum clothes line wire from 1/16 to 1/8 in diameter and steel wire of the same diameter was formed into open end rings 93 of one rotation as well as multi-rotation rings 94 just larger than the diameter of the rope 90. They were then slid over the end of the rope 90 with a pair of pliers. The rope 90 was then pulled so that the collar 92 seated against the bearing 91 and the rope 90 could not be pulled through.

When an exerciser desires to jump rope, the exerciser grips a first handle 20*a* of the jump rope with the right hand and a second handle 20*b* of the jump rope with a left hand. Each handle portion 111 of a handle is shaped to conform with the hands of the user so the rope 25 extends from the respective handle portion between the thumb, and index finger of the hand of the user. In this way, the handle portion 111 of each handle is held naturally by the user so the user does not have to bend the wrist. When the user begins to exercise and jump rope, the primary motion is a rotation of each arm from the elbow down to the hand in a small circular action with some minimal rotation of the wrist to cause of the rope to twirl around the user while the user jumps the rope.

If the user decides the length of the rope 25 is too short or too long, the user then takes each handle and inserts a rod through a keyhole 81 in the handle and pries out the bearing assembly 83 from the bearing cavity 74. The user then removes the wire ring 94 crimped on the end of the rope 25 and crimps on a new wire ring 94 at a new location on the rope 25 which results in a different length of the rope 25 for jumping depending on whether the user wishes the rope to be longer or shorter. Alternatively, the rope 25 itself can be changed in this way so a different durometer rope 25 or a different weighted rope 25 can be used for exercise.

Also, while the bearing assembly 83 is removed from the handle, the weight 61 disposed in the cavity 59 of the handle can be changed so the handle is made heavier or lighter, again depending on the purposes and desires of the exerciser. When the desired weight 61 is in place, or the desired length of rope 25 is attained, the rope 25 is pulled through the bearing assembly 83 until the wire ring 94 contacts the bearing assembly 83, thus preventing the rope 25 from being pulled any further through the bearing assembly 83. The bearing assembly 83 is then angled back into the bearing cavity 59 of the handle until it snaps into place. The handle is then ready for exercise again.

Figure 17:
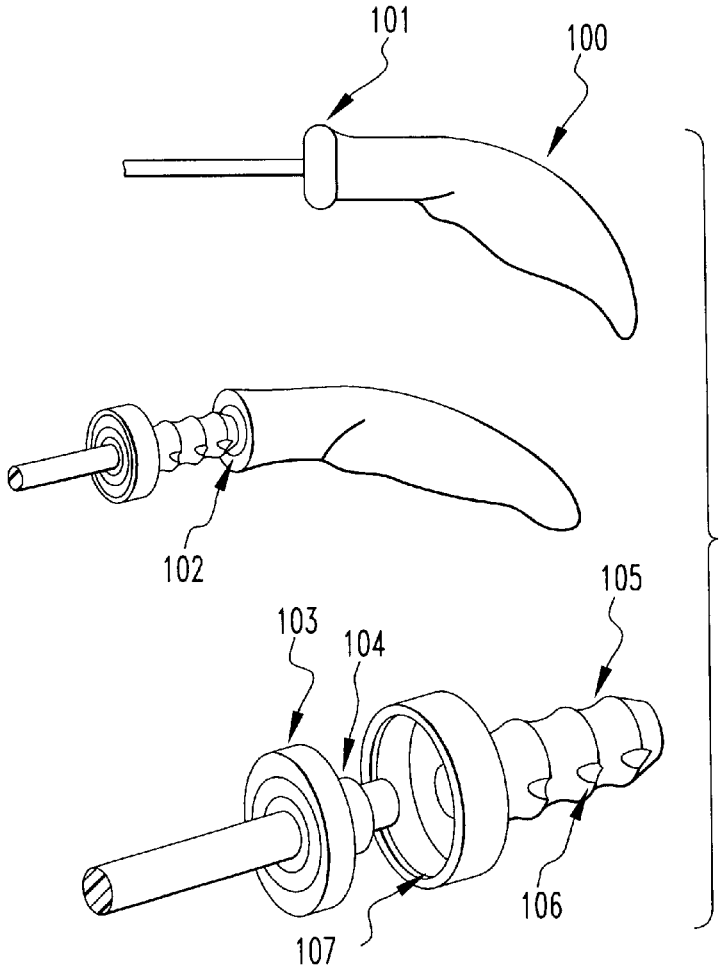
FIG. 17 is a schematic representation of another embodiment of a handle of the present invention.

In another embodiment, and as shown in FIG. 17, there is a soft rubber handle 100. At the front of the handle 100 where the handle 100 receives the rope, there is a hard plastic bearing holder 101. The hard plastic bearing holder 101 serves to better maintain the bearing 103 in place and will not bend or compress as much as the soft rubber handle 100 bends or compressors under normal use. In this way, the bearing holder 101 better serves to maintain a bearing 103 in place with the handle 100 during normal use.

The rope is maintained in place in the rubber handle 100 with the bearing 103 through which the rope extends. On the rope is a stop 104 which is squeezed onto the rope and prevents the rope from passing back out of the bearing 103 and separate from the bearing 103. The bearing 103 with the rope passing through it fits into the holder 101 and snaps into a snap flange 107 at the front of the holder 101. The snap flange 107 holds the bearing 103 in the holder 101. The holder 101 has a stem with locking teeth 105 and anti-rotation notches 106. The locking teeth 105 mate with the handle 100 through the holder hole 102 in handle 100. The interior shape of the holder hole 102 of the handle 100 is anti-symmetrical with the locking teeth 105 so the locking teeth 105 catch and mate with the corresponding anti-symmetrical teeth of the interior of the handle 100 in the hole 102. The locking teeth 105 prevent the holder 101 separating from the handle 100. Also inside the handle 100 along the hole 102 are slots which mate with the anti-rotation notches 106 so the holder 101 will not rotate in the handle 100 during use. If the rope is desired to be lengthened or shortened, the bearing 103 can be pried out of the snap flange 107 and the stop 104 removed or repositioned so the length of the rope can be adjusted. The rope, once re-adjusted with the stop in place, can be placed back into the handle through the bearing being snapped back into the holder 101.

The preferred radius for the axis of the jump rope handle is 2% inches with a range of 2 to 3 inches continuous radius.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A jump rope comprising:

a first handle;

a second handle; and a rope connected to the first handle and the second handle, the first handle and the second handle each comprising:

a handle portion having a receiving area and an end, said handle portion having a non-linear central axis which has a continuously curved radius of curvature of between 2–3 inches that extends entirely along the length of the handle portion from the receiving area to the end of the handle which is adapted to be held by a hand of a user which does not require any bending of the wrist of the hand of the user; and a mechanism for holding the rope, said mechanism mates with the receiving area to connect with the handle portion.

2. A jump rope handle as described in claim 1 wherein the handle portion has a non-cylindrical shape which is adapted to contour to the hand such that the rope exits the hand between the index finger and the thumb of the user, said handle portion can be held by all fingers.

3. A jump rope handle as described in claim 2 wherein the holding mechanism includes a bearing assembly where the rope exits the grip.

4. A jump rope handle as described in claim 3 wherein the handle portion is made of a rubberized polymer.

5. A jump rope handle as described in claim 4 wherein the handle portion includes a weight.

6. A jump rope handle as described in claim 5 wherein the handle portion includes a weight disposed inside the grip.

7. A jump rope handle as described in claim 3 wherein the handle portion is made out of a polymer containing metal.

8. A jump rope handle as described in claim 3 wherein the holding mechanism includes a key hole for popping out the bearing assembly to adjust or replace the rope.

9. A jump rope handle as described in claim 8 wherein the holding mechanism includes a retaining collar which can be moved up and down on the rope.

10. A method of a user exercising comprising:

gripping a first handle of a jump rope, the first handle having a handle portion having a receiving area and an end, the handle portion having a non-linear axis which has a continuously curved radius of curvature of between 2–3 inches that extends entirely along the length of the handle portion from the receiving area to the end of the handle, with a right hand of the user;

gripping a second handle of the jump rope, the second handle having a handle portion having a receiving area and an end, the handle portion having a non-linear central axis which has a continuously curved radius of curvature of between 2–3 inches that extends entirely along the length of the handle portion from the receiving area to the end of the handle, with a left hand of the user; and jumping the jump rope by the user while the user does not bend the wrist of either the right or left hand.

11. A method as described in claim 10 wherein the gripping steps include the steps of gripping the handle so the rope exits the respective hand between the thumb and index finger.

12. A jump rope as described in claim 1 wherein the continuously curved radius for the axis is 2–3 inches.

13. A jump rope as described in claim 10 wherein the continuously curved radius for the axis is 2–3 inches.

* * * * *